United States Patent [19]

Lyon

[11] 4,156,491

[45] May 29, 1979

[54] ATTACHMENT FOR CONTAINER CLOSURE

[76] Inventor: Newton E. Lyon, P.O. Box 113, Bennett, Colo. 80102

[21] Appl. No.: 923,073

[22] Filed: Jul. 10, 1978

[51] Int. Cl.[2] ..... B65D 51/24

[52] U.S. Cl. ..... 215/302; 81/3.4

[58] Field of Search ..... 215/302, 10; 220/284; 81/3.1 C, 3.34, 3.48, 3.4

[56] References Cited

U.S. PATENT DOCUMENTS

| | | | |
|---|---|---|---|
| 1,207,560 | 12/1916 | Keeran | 81/3.34 |
| 1,467,936 | 9/1923 | Janssen | 81/90 C X |
| 1,919,866 | 7/1933 | Schacht | 81/3.4 |
| 1,932,147 | 10/1933 | Sabatine | 215/302 |
| 2,094,567 | 9/1937 | Barnby | 215/302 |
| 2,804,225 | 8/1957 | Lee | 215/302 X |
| 3,043,171 | 7/1962 | Lederer | 81/90 C |
| 3,298,415 | 1/1967 | Klygis | 215/302 X |
| 3,460,701 | 8/1969 | Powalowski | 215/10 |
| 3,730,025 | 5/1973 | Monnerjahn | 81/3.4 |

*Primary Examiner*—Donald F. Norton
*Attorney, Agent, or Firm*—Dean and Flickinger

[57] ABSTRACT

A base is securable to the lid of a conventional container assembly which also includes a vessel. The base includes an inwardly directed flange which abuts the top panel of the lid and a downwardly directed flange which encircles the skirt of the lid. Upstanding from the base are lugs which provide diametrically opposed shoulders for receiving a leverage tool for the purpose of rotating the lid relative the vessel.

3 Claims, 6 Drawing Figures

ATTACHMENT FOR CONTAINER CLOSURE

This invention relates to container assemblies.

In a further aspect, the present invention relates to container assemblies of the type having a lid rotatably engageable with a vessel.

More particularly, the instant invention concerns an attachment securable to the lid to facilitate rotating the lid relative the vessel.

Foodstuffs, cleansing products and other commodities well known to the household are frequently packaged in container assemblies of the type having a vessel and a detachable closure. Vessels, available in an array of sizes, shapes and materials, commonly have a continuous sidewall with a closed bottom and an open top. Closures, generally referred to as lids, tops and caps, are also produced in assorted designs and from a variety of materials. Carried proximate the top of the vessel is some type of engagement means for detachably receiving the enclosure. Usually the engagement means are of the camming type, as generally provided by one or more helical surfaces. The closure includes a top panel which extends over the top of the vessel and depending skirt which encircles the upper portion of the side wall. Means, mateable with the engagement means of the vessel, are carried by the skirt.

The closure is rotatable relative the vessel for selective attachment or detachment. Accordingly, the closures are termed "screwed caps," "twist tops," and other analogous colloquial names. It is well known that such closures, as a result of sealing, aging, contamination, environmental changes, and other factors, are frequently very difficult to rotate. This is a source of general concern. The problem is particularly acute among the young, the elderly, the infirm, and others with reduced manual strength and dexterity.

Traditional attempts to remove a stubborn closure include applying heat, usually hot water, to the area of engagement, and tapping the area of the engagement. Prior art has also provided devices which purportedly facilitate removal of closures. Pincer type devices, for example, are well known.

Another prior art suggestion involves modification of the closure to provide for a use of a leverage tool. The tool may be especially designed or may be any convenient, elongate, rigid item, such as a common table knife or a screwdriver. Basically, a pair of diametrically opposed shoulders are provided to receive opposite sides of the tool. The shoulders may be formed by a recess in the closure, or lugs upstanding from the closure.

Exemplary of modified closures are the structures disclosed in the following issued U.S. Pat. Nos. 2,094,567 Barnby; 627,292 Brant; 629,982 Brant; 2,067,117 Carhart; 1,610,939 Fay; 38,820 Gray et al; 3,298,415 Klygis; 2,738,891 Pitto; 1,351,304 Shelton; 3,217,915 Weygandt.

The foregoing references were discovered during a search conducted within the U.S. Patent and Trademark Office.

U.S. Pat. No. 2,094,567 is exemplary of a closure having a leverage tool receiving recess formed therein. U.S. Pat. No. 1,351,304 is typical of a closure having upstanding lugs. An especially designed leverage tool is illustrated in U.S. Pat. No. 627,292. A slot which receives a conventional kitchen knife is the subject of U.S. Pat. No. 1,610,939.

The foregoing are typical of the current state of the art. While the single objective of facilitating the removal or engagement of the closure member appears to be met by the several references, certain inherent limitations reside within the references. Upstanding lugs or other obstructions upon the top of the closure prevent stacking of the containers, which is a preferred and usual practice within retail establishments and with households. Distortion of the upper surface of the closure, to provide slots, channels or other appendages, imposes restrictions upon the preferred practice of manufacturers to imprint various indicia upon the top of the closure. Further, such arrangements require especially fabricated closure members. Unique leverage tools are less than satisfactory, since the tool may be misplaced or not readily available when needed.

A remedy to the foregoing limitations is not disclosed by a single reference, nor suggested by the combination of the several references. It would be highly advantageous, therefore, to provide new and novel structure, not suggested by the prior art, which will alleviate the foregoing and other limitations imposed by the prior art.

Accordingly, it is an object of this invention to provide improved means to facilitate removal or engagement of the closure of a container assembly.

Another object of the invention is the provision of an attachment for a closure.

And another object of the invention is to provide an attachment for use with conventional closures.

Still another object of the invention is the provision of an attachment which can be secured to a presently commercially available closure without modification thereof.

Yet another object of the present invention is to provide an attachment which receives a leverage tool for rotating a closure relative a vessel.

Yet still another object of the invention is the provision of an attachment which will accept various common items as a leverage tool.

A further object of the invention is to provide an attachment whereby container assemblies may be stacked one upon another.

And a further object of the invention is the provision of an attachment whereby a supplier may package a product in a given container assembly and optionally include said attachment.

Still a further object of the invention is to provide an attachment which is selectively either permanently or removably attached to a closure.

And still a further object of the invention is the provision of an attachment of the above type which is relatively inexpensive to manufacture, yet is conveniently and effectively usable.

Briefly, to achieve the desired objects of the present invention, in accordance with a preferred embodiment thereof, first provided is a base which is securable to the closure member of a container assembly. Upstanding from the base are a pair of diametrically opposed shoulders for receiving respective opposite sides of a leverage tool which may be in the form of a screwdriver or common table knife. Taken together, the base and the shoulders comprise an attachment, which, in response to force exerted upon the leverage tool, rotates the closure member relative the vessel of a container assembly.

In a further embodiment, the base includes a downwardly directed flange which receives the skirt of the closure member, and an inwardly directed flange which is received against the top panel of closure member. The shoulders are formed by a pair of opposed lugs upstanding from the base and defining a pair of tool receiving recesses therebetween. The lugs are positioned proximate the perimeter of the base to receive therebetween the lower portion of a subsequent similar vessel in stacking arrangement, the bottom of the subsequent vessel resting upon the top panel of the immediate closure member.

The foregoing and further and more specific objects and advantages of the instant invention will become readily apparent to those skilled in the art from the following detailed description thereof, taken in conjunction with the drawings, in which.

Figure 1:
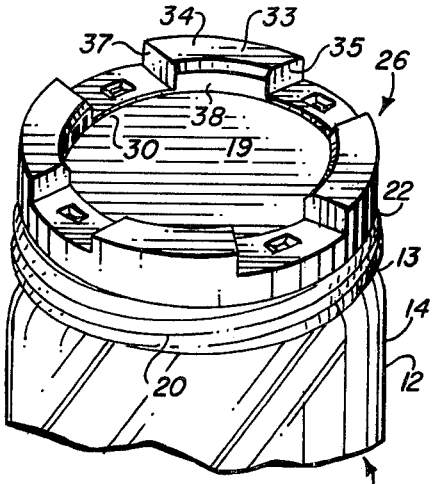
FIG. 1 is a perspective view of the upper portion of a container assembly, including a vessel and a closure member, and having an attachment constructed in accordance with the teachings of the instant invention secured thereto.
Figure 4:
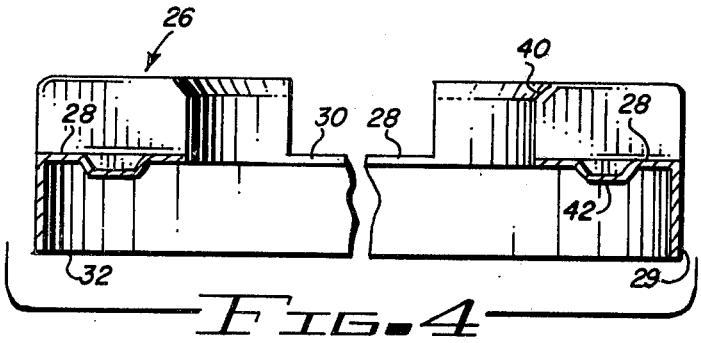
FIG. 4 is a vertical sectional view taken along the line 4—4 of FIG. 2.
Figure 2:
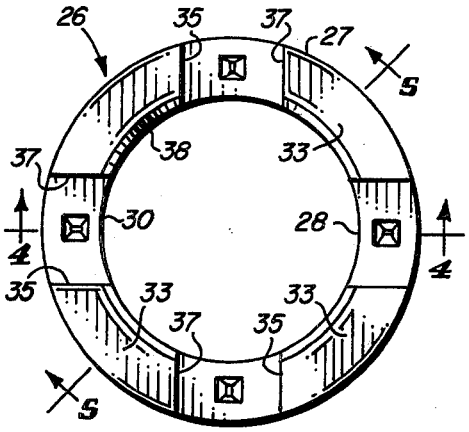
FIG. 2 is a top plan view of the attachment illustrated in FIG. 1.
Figure 5:
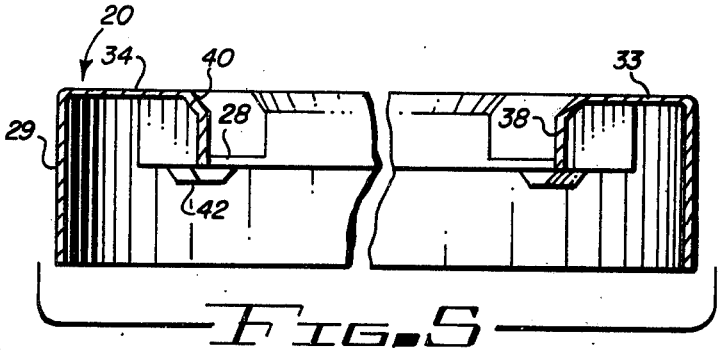
FIG. 5 is a vertical sectional view taken along the line 5—5 of FIG. 2.
Figure 3:
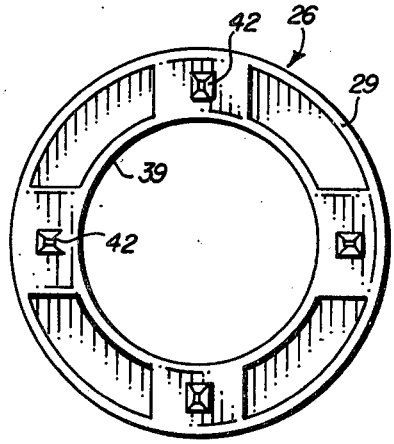
FIG. 3 is a bottom plan view of the attachment of FIG. 1.

Turning now to the drawings, in which like reference characters indicate corresponding elements throughout the several views, attention is first directed to FIG. 1, which shows a container assembly, generally designated by the reference character 10, including vessel 12 and closure member 13. Vessel 12, as also viewed in FIG. 6, has a continuous upright side wall 14, with closed bottom 15 and open top 17. Carried by side wall 14, proximate open top 17, are engagement means, herein specifically illustrated in the form of male screw thread 18.

Closure member 13 includes top panel 19 and depending skirt 20. Skirt 20 encircles a portion of side wall 14 proximate open end 17. Female screw thread 22 carried by skirt 20 provides mating engagement means detachably securable to male screw thread 18.

The foregoing description is set forth as being typical of commercially available pre-existing container assemblies. It is understood that such container assemblies are fabricated in a variety of sizes, shapes and materials. Vessels are commonly molded or cast of glass or plastics. Typically, closure members are cast from plastic or stamped of metal. Engagement means of diverse types are also known, however, engagement means are usually in the form of one or more helical surfaces. It is also known to fabricate the closure member as a two-piece structure, a skirt portion having an inwardly directed annular flange, which rests over a separable top panel.

An attachment constructed in accordance with the teachings of the instant invention is useful in connection with the various types of container assemblies, as set forth above. With specific reference to FIG. 1, the attachment, embodying the principles of the instant invention and generally designated by the reference character 26, is viewed as it would appear when secured to closure member 13. Attachment 26, as further viewed in FIGS. 2–5, includes a base portion 27, having an inwardly directed flange 28 and a downwardly directed flange 29. Inwardly directed flange 28 terminates with an inner peripheral edge 30 defining an opening therethrough and downwardly directed 29 terminates with lower edge 32.

Spaced apart lugs 33 extend upwardly from base portion 27. Each lug 33 includes a top section 34 and first and second shoulders 35 and 27, respectively, which extend between inwardly directed flange 28 and top section 34. Defined between respective first and second shoulders 35 and 37 of adjacent lugs 33 are tool receiving recesses.

An inner wall 38, having lower edge 39, depends from the top section 34 of each lug 33. As seen in plan view, FIG. 2, inner wall 38 is arcuate and continuous with inner peripheral edge 30. Lower edge 39 terminates in the plane of inwardly directed flange 28, resting upon top panel 19 of closure member 13. The junction of top section 34 and inner wall 38 is truncated by beveled surface 40. Projections 42 depend from inwardly directed flange 28.

Figure 6:
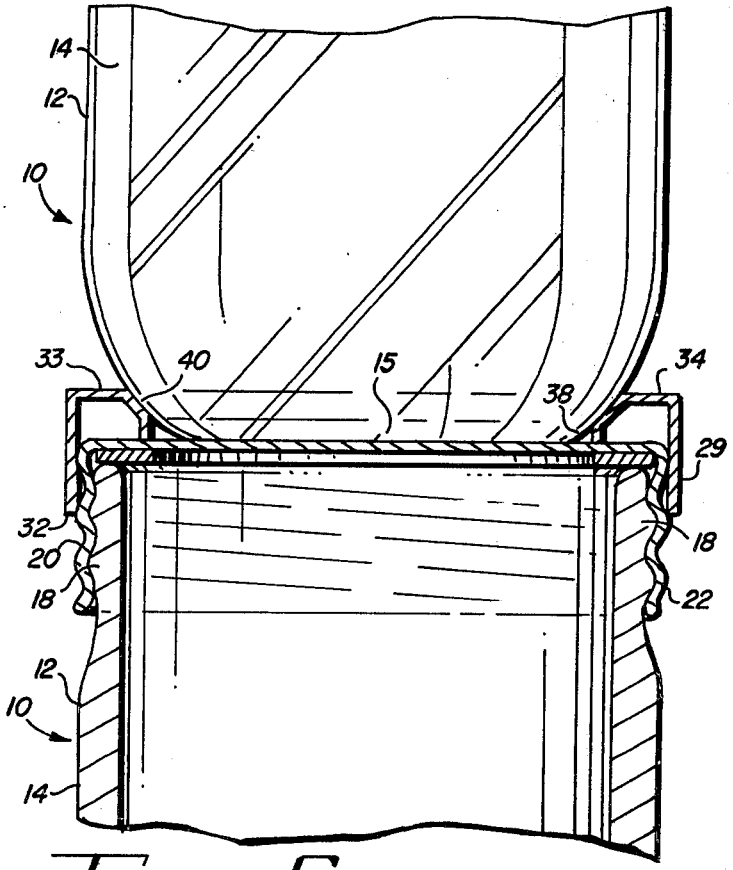
FIG. 6 is a vertical sectional view taken approximately long the vertical axis thereof, and especially illustrating the container assembly and attachment when used in stacking arrangement to support another similar container assembly.

While the attachment of the instant invention may be fabricated of various material, and, in accordance with numerous manufacturing techniques as will readily occur to those skilled in the art, it is generally preferred that the device be formed as an integral sheet metal stamping. In the assembled position, as seen in FIG. 6, downwardly directed flange 29 of the attachment 26 encircles skirt 20 of closure member 13. While the length of downwardly directed flange 29 is optional, it is generally preferred that lower edge 32 reside intermediate of skirt 20, which is considered sufficient for the immediate purpose. Lower edge 32 of inner wall 38 and inwardly directed flange 28 bear against top panel 19 of closure member 13.

Various methods of securing the attachment 26 of the instant invention to the closure member 13 will readily occur to those skilled in the art. The securement may be either permanent or semi-permanent. Permanent securement is easily accomplished by conventional welding, especially spot welding, techniques. Specifically, spot welding may be used to secure inwardly directed flange 28 to top panel 19 as locations approximated by projections 42 or at other conventional locations, such as between downwardly directed flange 29 and skirt 20. Downwardly directed flange 29 may also be crimped or swedged to permanently grasp skirt 20. For permanent securement, projections 42 may be eliminated. For semi-permanent securement, downwardly directed flange 29 is sized to tightly receive skirt 20, requiring that attachment 26 be tapped onto closure member 13. During the latter assembly, indentations are formed in top panel 19 by projections 42. Projections 42 reside within the respective dents to increase the mechanical and frictional bond to limit relative rotation between the attachment and the closure member. For this purpose, projections 42 may include a straight knurl perpendicular to the direction of rotation.

For semi-permanent securement, attachments may be made available to the consumer in sizes appropriate for standard closure members. The attachment is forced onto a container at the time of purchase, and removed when the goods are consumed and subsequently placed upon another container. Permanent securement is best accomplished by the container manufacturer. It is noted that substantially all of the top panel is unobscured for viewing indicia normally printed upon such top panel. Accordingly, the manufacturer may supply products in a standard container, a percentage of which include the attachment of the instant invention.

Conventionally, containers are stored in stacked arrangement upon the shelves of retail establishments. Frequently, containers are stacked within the carton during shipment. As seen in FIG. 6, the attachment of the instant invention preserves the integrity of the stackability of conventional containers. Conventionally, containers, especially glass jars, are curved inwardly near the bottom. Beveled surface 40 accommodates the curve such that the side wall 14 of vessel 12 is received within the attachment 26 and the bottom 15 of vessel 12 rests upon top panel 19 of closure member 13.

Closure member 13 is readily removed from vessel 12 by placing a leverage tool, such as a common kitchen knife or screwdriver, into opposed recesses formed between lugs 33. For rotation in one direction, respective sides of the leverage tool bear against diametrically opposed shoulders 35. For rotation in the other direction, respective sides of the leverage tool bear against diametrically opposed shoulders 37. The foregoing method assumes that the vessel is held in one hand while the leverage tool is manipulated with the other. It is also envisioned that the vessel may be held in both hands for purposes of rotation, and the rung of a chair, edge of a counter or other permanent projection functions as the leverage tool.

Various changes to the device herein chosen for purposes of illustration will readily occur to those skilled in the art. To the extent that such variations and modifications do not depart from the spirit of the invention, they are intended to be included within the scope hereof which is limited only by a fair interpretation of the appended claims.

Having fully described and disclosed the present invention and preferred embodiments thereof in such clear and concise terms as to enable those skilled in the art to understand and practice the same, the invention claimed is:

1. In a container assembly including a vessel having an upstanding side wall with a closed bottom and an open top, and a closure member including a top panel with a depending skirt and rotatably engageable with the top of said vessel, an attachment securable to said closure member for engageably receiving a leverage tool and for rotating said closure member, said attachment comprising:

(a) a base securable to said closure member;

(b) leverage tool receiving means upstanding from said base;

(c) a downwardly directed skirt on said base shaped and sized to receive the skirt of said closure member therein; and (d) an inwardly directed flange on said base and receivable against the top panel of said closure member.

2. In the container assembly and attachment of claim 1, together with a pair of diametrically opposed shoulders upstanding from said base which includes a pair of diametrically opposed lugs upstanding from said inwardly directed flange and defining a pair of diametrically opposed tool receiving recesses therebetween, each said lug carrying one of said pair of shoulders.

3. In the container assembly and attachment of claim 2, wherein said lugs are spaced to receive the sidewall of said vessel when the bottom of said vessel rests upon the top panel of said closure member.

* * * * *